US008818895B2

(12) United States Patent
Nagy

(10) Patent No.: US 8,818,895 B2
(45) Date of Patent: Aug. 26, 2014

(54) VEHICLE DEVICE, AD HOC NETWORK AND METHOD FOR A ROAD TOLL SYSTEM

(75) Inventor: Oliver Nagy, Vienna (AT)

(73) Assignee: Kapsch Trafficcom AG, Vienna (AT)

( * ) Notice: Subject to any disclaimer, the term of this patent is extended or adjusted under 35 U.S.C. 154(b) by 143 days.

(21) Appl. No.: 13/353,007

(22) Filed: Jan. 18, 2012

(65) Prior Publication Data

US 2012/0209776 A1 Aug. 16, 2012

(30) Foreign Application Priority Data

Feb. 16, 2011 (EP) ..... 11450023

(51) Int. Cl.
*G06F 21/00* (2013.01)
*G06Q 50/30* (2012.01)

(52) U.S. Cl.
CPC ..... *G06Q 50/30* (2013.01)
USPC ..... 705/50

(58) Field of Classification Search
CPC ..... G06Q 50/30
USPC ..... 705/50; 701/201
See application file for complete search history.

(56) References Cited

U.S. PATENT DOCUMENTS

| | | | | |
|---|---|---|---|---|
| 5,919,239 | A * | 7/1999 | Fraker et al. | 701/473 |
| 6,393,346 | B1 * | 5/2002 | Keith et al. | 701/521 |
| 2010/0250053 | A1 * | 9/2010 | Grill et al. | 701/33 |
| 2011/0087429 | A1 * | 4/2011 | Trum | 701/201 |

FOREIGN PATENT DOCUMENTS

| | | | |
|---|---|---|---|
| DE | 102 58 653 | A1 | 9/2003 |
| EP | 2 017 790 | A2 | 1/2009 |
| EP | 2 330 562 | A1 | 6/2011 |
| WO | WO 2009/015989 | A1 | 2/2009 |

OTHER PUBLICATIONS

Extended European Search Report for corresponding European Patent Application No. 11450023.4, dated Jul. 7, 2011, 10pp.
De Boer William et al.; "Road Pricing: Security architecture KMH Road Pricing System"; Technolution Automation Technology; dated Aug. 22, 2002.

* cited by examiner

*Primary Examiner* — Charles C Agwumezie
(74) *Attorney, Agent, or Firm* — Fiala & Weaver P.L.L.C.

(57) ABSTRACT

A vehicle device for a road toll system including: a satellite navigation receiver for continuously generating location data for a processing and transmitting/receiving unit of the vehicle device; and a trusted-element processor configured to log a time segment of the generated location data and to cryptographically signing said time segment. The trusted-element processor is further configured to start said logging upon detection of a predefined time or a predefined location of the vehicle device and to carry out said logging for a predefined time segment.

13 Claims, 2 Drawing Sheets

VEHICLE DEVICE, AD HOC NETWORK AND METHOD FOR A ROAD TOLL SYSTEM

CROSS-REFERENCE TO RELATED APPLICATION(S)

This application claims priority to European Patent Application No. 11 450 023.4, filed on Feb. 16, 2011, the contents of which are hereby expressly incorporated by reference.

FIELD OF THE INVENTION

The present invention is directed to a vehicle device and a method thereof for a road toll system and more specifically to a vehicle device and a method thereof for generating location data, logging a time segment for the location data, and cryptographically signing said time segment.

BACKGROUND

EP 2 017 790 A2 describes the utilization of a trusted-element for signing the location recordings transmitted by an OBU to a map-matching proxy. In this case, the trusted-element also serves for encrypting the interface between OBU and map-matching proxy.

"Secure monitoring" concepts that are based on a logging and segmental signing ("real-time freezing") of the location recordings of the vehicle devices of the road toll system are used for monitoring and controlling the proper functioning of interoperable road toll systems, such as the new European Electronic Toll Service (EETS). The signing is realized with trusted-element processors that contain a cryptographic signature ("trusted element certificate") of the controller such as, a road operator, an agency, etc. ("certificate issuer"), and therefore are trusted by said controller. Details on the secure monitoring or secure freezing concept can be found, for example, in the publications "Security aspects of the 1,11 EETS," Expert Group 12, Final report V1.0, Apr. 5, 2007; "Electronic fee collection—Application interface definition for autonomous systems—Part 1: Changing," ISO Technical Specification 17575-1, Jun. 15, 2010; and "An example of a view on EETS trust and privacy in GNSS-based toll systems," Vis J, Report Ministry of Transport, Public Works and Water Management of The Netherlands, Dec. 15, 2009.

In the conventional systems, all location data accumulating in the vehicle device is logged and segmentally signed in a continuous fashion ("frozen"). Subsequently, the signed time segments are read out with an external control device for control purposes. This is associated with the accumulation of a large volume of data and requires a correspondingly large storage space for storing the signed data on the one hand, and separate control devices for reading out the signed data on the other hand.

SUMMARY

In some embodiments, the present invention is a vehicle device for a road toll system including: a satellite navigation receiver for continuously generating location data for a processing and transmitting/receiving unit of the vehicle device; and a trusted-element processor configured to log a time segment of the generated location data and to cryptographically signing said time segment. The trusted-element processor is further configured to start said logging upon detection of a predefined time or a predefined location of the vehicle device and to carry out said logging for a predefined time segment.

The trusted-element processor may further be configured to detect the predefined location in its own generated location data, detect the predefined location in external location data that it receives from proximate vehicle devices via a wireless network, receive and match the external location data of several proximate vehicle devices to detect the predefined location in the matched external location data, anonymously retrieve the external location data, retrieve the external location data by exchanging a key having one or more of temporally and locally limited validity, and to take into consideration only external location data received under a valid key, send the signed time segment to a control center of the road toll system by the transmitting/receiving unit of the vehicle device, and/or make the signed time segment available for retrieval via an interface of the vehicle device.

The wireless network may be an ad hoc network, which operates in accordance with the WAVE or WLAN standard.

In some embodiments, the present invention is an ad hoc network of at least two vehicle devices according to the above that are connected to one another via their transmitting/receiving units, wherein at least one vehicle device is further configured to make available location data to another vehicle device that detects a predefined location therein to start the logging of its own location data.

In some embodiments, the present invention is a method or logging location data of a location-recording vehicle device of a road toll system with several vehicle devices that can exchange location data in a wireless fashion. The method comprises the following steps performed in a first vehicle device: detecting a predefined time; logging a time segment of the location data of the first vehicle device and receiving location data of a second vehicle device; and signing the logged time segment and the received location data with a cryptographic signature.

BRIEF DESCRIPTION OF THE DRAWINGS

The invention is described in greater detail below with reference to an exemplary embodiment that is illustrated in the attached drawings.

DETAILED DESCRIPTION

Figure 1:
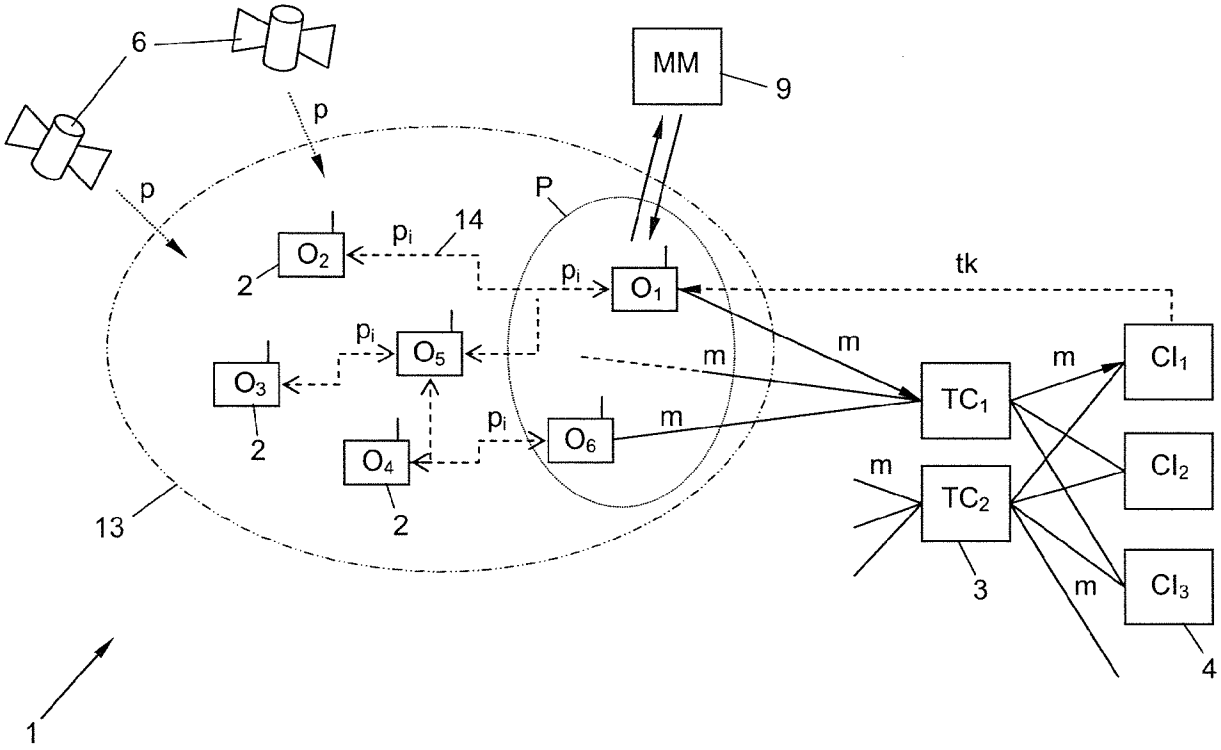
FIG. 1 is an exemplary block diagram of a road toll system with vehicle devices in an inventive ad hoc network, according to some embodiments of the present invention.

The present invention is directed to a vehicle device for a road toll system that is also referred to as an "onboard unit" or OBU, with a satellite navigation receiver for continuously generating location data for a processing and transmitting/receiving unit of the vehicle device and a separate trusted-element processor for logging a time segment of the generated location data and for cryptographically signing said time segment. The invention furthermore pertains to an ad hoc network of at least two such vehicle devices, as well as to a method for logging location data of a location-recording vehicle device of a road toll system with several vehicle devices that can exchange location data in a wireless fashion.

The present invention develops an improved secure-monitoring solution for interoperable road toll systems. According to a first aspect of the invention, a vehicle device includes a trusted-element processor is configured to start logging upon the detection of a predefined time or a predefined location of the vehicle device and to carry out this logging for a predefined time segment.

In this way, the vehicle device is used for monitoring itself. That is, the thusly programmed trusted-element processor acts similar to a computer virus that at a predefined time or at a predefined location collects location data in the vehicle device and makes this location data available for control purposes for a limited time. The aforementioned functionality of the trusted-element processor "sleeps" until it is used and then carries out an individual segmental logging. Therefore, it is no longer necessary to continuously log, sign, and store ("freeze") all location data, and a separate control device for triggering the monitoring process can also be eliminated.

It goes without saying that the predefined location being detected does not necessarily have to be a point, but rather may also be extended, such as, e.g., a district, a specific road, etc. According to a first variation of the invention, the trusted-element processor detects the predefined location in the location data of its own vehicle device such that the effort is minimized.

In some embodiments, the trusted-element processor detects the predefined location in external location data that it receives from proximate vehicle devices via a wireless network. This represents a qualitative leap in the security of the monitoring process, that is, the location data of other vehicle devices is not dependent on possible manipulations or malfunctions of the controlled vehicle device. The use of external location data as starting criterion for the secure freezing of the location data therefore enables the controller or certificate issuer to control the proper functioning of a vehicle device in a highly secure fashion. The aforementioned proximate vehicle devices do not necessarily have to be carried in vehicles; they may also be infrastructure-based and stationary.

The wireless network may be an ad hoc network, particularly a vehicular ad hoc network (VANET) that operates in accordance with the WAVE (wireless access in vehicular environments) standard or the WLAN (wireless local area network) standard. Such networks can be formed among a group of proximate vehicle devices that are located within mutual transmission/reception range.

In some embodiments, the trusted-element processor receives and matches the external location data of several proximate vehicle devices to detect the predefined location in the matched external location data.

In some embodiments, to meet confidentiality requirements, the trusted-element processor may retrieve the external location data of the proximate vehicle devices anonymously such as, e.g., under a randomly selected (anonymous) network sender identification, a MAC address in the ad hoc network that cannot be attributed without additional information etc.

To improve the control security, the trusted-element processor may retrieve the external location data by exchanging a key with temporally and/or locally limited validity and take into consideration only the external location data received under a valid key. This makes it possible to verify the timeliness of the location data used as starting criterion and/or its proximity area; in a highly mobile environment such as a VANET, this makes it possible to improve the accuracy in locating the logged vehicle device.

In some embodiments, the trusted-element processor can send the signed time segment to a control center of the road toll system by means of the transmitting/receiving unit of the vehicle device. Alternatively, the trusted-element processor may make the signed time segment available for retrieval via an interface of the vehicle device.

FIG. 1 shows an interoperable road toll system 1 that includes a plurality of vehicle devices (onboard units, OBUs, $O_1$-$O_6$) 2, a plurality of different toll operator centers (toll chargers, $TC_1$, $TC_2$) 3 and a plurality of different billing centers (certificate issuers, $CI_1$-$CI_3$) 4. The vehicle devices 2 continuously determine their location p in a global navigation satellite system (global navigation satellite system, GNSS) 6 by the satellite navigation receivers 5 (FIG. 2) and generate a continuous stream (track) of location data (position fixes) $p_i$ thereof.

Figure 2:
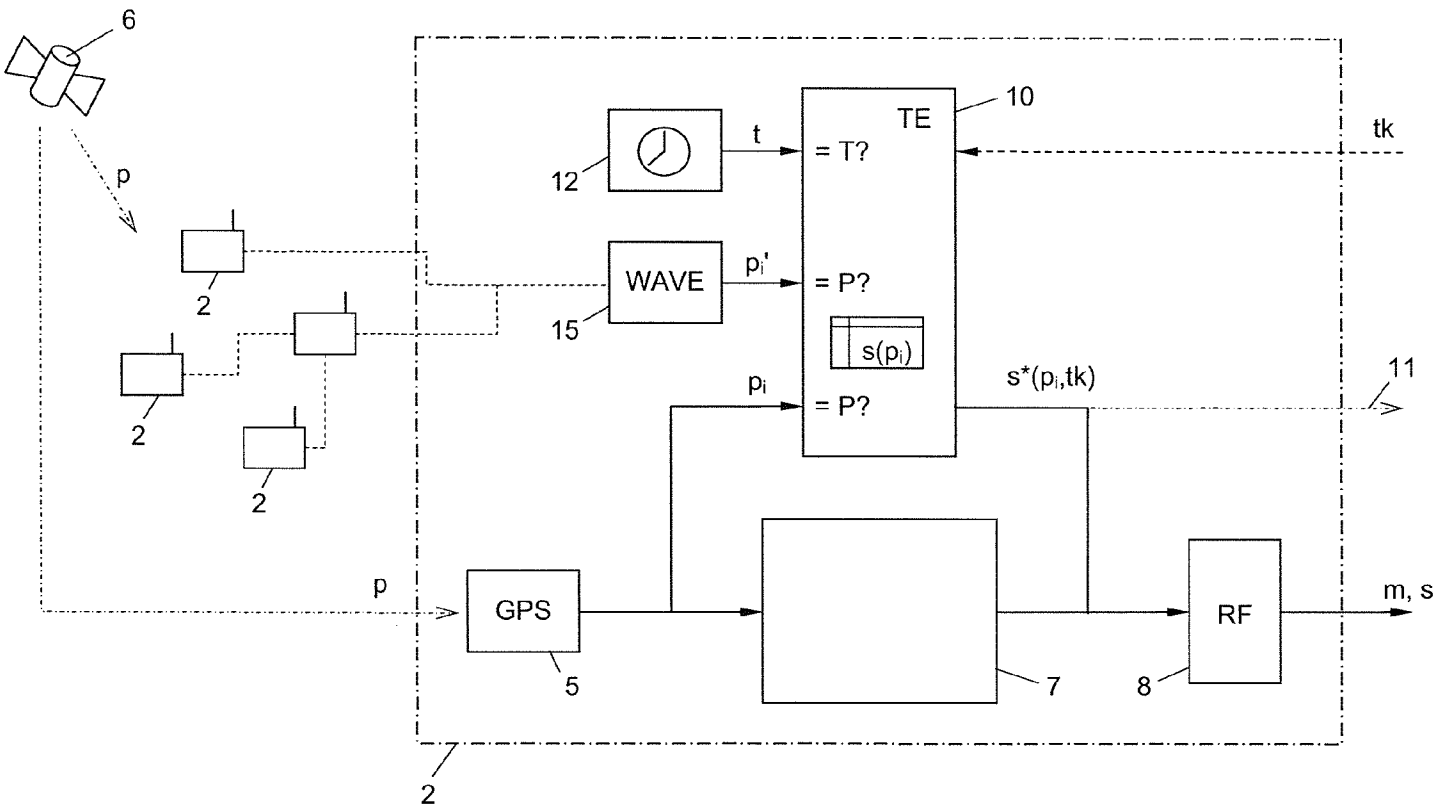
FIG. 2 is an exemplary block diagram of a detailed representation of one of the vehicle devices, according to FIG. 1.

Each vehicle device 2 transmits its location data $p_i$ to a billing center 4 via an operator center 3 either in "raw form" or processed into toll data m with the aid of a processing and transmitting/receiving unit 7, 8 (FIG. 2). The processing segment 7 of the unit 7, 8 includes a microprocessor and the transmitting/receiving segment 8 of the unit 7, 8 includes a DSRC (dedicated short-range communication) transceiver, a WAVE transceiver, a WLAN transceiver, or a PLMN (public land mobile network) transceiver.

The toll data m includes accumulated and location-anonymized toll transaction datasets that specify, for example, the number of kilometers traveled, a traveled segment of a road network, the time spent in a toll area (e.g., congestion charges), etc. To generate the toll data m of the location data $p_i$, the location data can be matched, for example, with previously stored toll maps ("map matching"). For this purpose, the vehicle devices 2 may also utilize, for example, an external map matching proxy (map matching proxy) 9, to which map matching tasks are outsourced under anonymized task identifications in order to preserve the confidentiality of the location data $p_i$, with respect to the operator and billing centers 3, 4. The toll data m may also be sent directly from the proxy 9 to the operator or billing centers 3, 4.

To monitor and control the functions of the vehicle devices 2 and the operating centers 3, each vehicle device 2 is equipped with a trusted-element processor 10 that contains a cryptographic signature (trusted key) tk, as shown in FIG. 2. The signature tk is issued, e.g., by a contract issuer CI, namely its owner of one of the billing centers 4, and is confidential for this contract issuer. In the context of the present description, the term "trusted-element processor" 10 refers to a processor element that is equipped with a cryptographic signature, access to which is cryptographically secured, for example, on the hardware level. Processor elements of this type meet strict security requirements such as, for example, those specified for single-chip processors integrated into SIM cards, credit cards, bank cards, etc.

The trusted-element processor 10 receives the stream of location data $p_i$ from the satellite navigation receiver 5 of the vehicle device 2 directly or via the processing segment 7 and is configured or programmed for recording the location data $p_i$ over a predefined time segment s such as 1, 5 or 10 minutes at a time, in response to specific requests or triggers. The recorded time segment $s(p_i)$ is subsequently signed by the trusted-element processor 10 with its cryptographic signature tk and therefore "frozen."

A data reduction of the time segment s may be carried out during the signing or even directly before the signing, for example, by forming a hash value thereof. In the following description, the term hash value refers to the application of a practically irreversible n:1 transformal function to an input dataset, i.e., a function that is reversible only in an (extremely) ambiguous fashion, such that the input dataset practically can no longer be deduced from a known hash value. Examples of such hash functions are the checksum function, the modulo function, etc.

The signed logged time segment is designated as $s^*(p_i, tk)$ in this case and subsequently sent to an operator center 3 by the transmitting/receiving unit 8 of the vehicle device 2 and from said operator center to a billing center 4. Based on the signature tk of the signed time segment s*, the billing center 4 can deduce the authentic origin of said time segment from a trusted-element processor 10 that enjoys its trust. The signed logged time segment s* may alternatively or additionally be made available for retrieval via an interface 11 of the vehicle device 2.

The start of the time segment s, in which the location data $p_i$ is logged, may be triggered in the trusted-element processor 10 in different ways. According to a some embodiments, the vehicle device 2 contains a timer 12 in the form of a "watchdog" that triggers said logging at a predefined time T, i.e., it "wakes up" the trusted-element processor 10 for said functionality when the current time is t=T.

A second starting criterion includes the trusted-element processor 10 detecting the occurrence of a predefined location P in the location data $p_i$. The predefined location P may include a selective location such as, e.g., a virtual toll station or of an extended location such as a parking area, a city center, a highway segment, etc. The logging over said predefined time segment starts as soon as the trusted-element processor 10 detects the location P in the location data $p_i$, that is, as soon as it determines that a location p in the location data $p_i$ lies within the boundaries or in the vicinity of the predefined location P. After the logging is completed, the signed logged time segment s* of the location data $p_i$ is available for its transmission and retrieval.

In some embodiments, the trusted-element processor 10 detects the occurrence of the predefined location P in external location data $p_i'$ that it receives from other (external) proximate vehicle devices 2 rather than in one's own location data $p_i$ of one's own vehicle device 2. This is described in greater detail below.

According to the illustrations in FIGS. 1 and 2, a group of vehicle devices 2 of the road toll system 1 may form a wireless network 13 by linking the vehicle devices to one another via wireless connections 14. The wireless connections 14 may be structured, for example, in accordance with the WAVE or WLAN standard and the wireless network 13 may be an ad hoc network or VANET. Here, each vehicle device 2 features a suitable wireless transceiver 15. The wireless transceiver 15 and the transmitting/receiving unit 8 of the vehicle device 2 may optionally be identical.

Vehicle devices 2 can inform one another about their respective current location p or, e.g., continuously exchange their location data $p_i$ within the wireless network 13. One such example is the exchange of Vehicle Service Table Messages (VST) messages within a VANET, in which the individual network nodes (vehicle devices 2) inform one another about their communication capabilities and the services they offer, as well as their recent locations p or their recent location data $p_i$, when a wireless connection 14 is established.

In some embodiments, a trusted-element processor 10 of a vehicle device 2 may also retrieve locations p or location data $p_i'$ of proximate vehicle devices 2 on its own at any time. The location data $p_i'$ of several proximate vehicle devices 2 received in a vehicle device 2 may also be matched with one another, e.g., with respect to consistency, in order to hide anomalous measured values or to average the received location data $p_i'$.

Retrieval or transmission keys with temporally and/or locally limited validity may be used for the retrieval or reception of the external location data $p_i'$ of the proximate vehicle devices 2 such that only external location data $p_i'$ that is received within a predefined time period or originates from a predefined local area around the vehicle device 2 is taken into consideration.

The trusted-element processor 10 is designed or programmed for detecting the appearance of the predefined location P in the external location data $p_i'$ of the proximate vehicle devices 2 and uses this as triggering criterion for starting the logging of the location recordings $p_i$ of its own vehicle device 2. Consequently, possible manipulations, corruptions or faults of its own location data $p_i$ are not taken into consideration in triggering the logging of the location data segment s or s*, so that the detection of a malfunction is simplified. That is, if the location recordings $p_i$ contained in the frozen time segment s* do not (approximately) correspond to the predefined location P that was detected in the external location data $p_i'$, a manipulation or a malfunction of the vehicle device 2 has occurred.

It is also possible to combine the above-described embodiments. For example, the timer 12 may cause the trusted-element processor 10 to retrieve the location data $p_i'$ of proximate vehicle devices 2 at a certain time t and to record and sign this external location data together with the time segment s of its own location data $p_i$, i.e., $s^*(p_i, tk, p_i')$, such that the proximate locations $p_i'$ can be taken into consideration in the verification of one's own location recordings $p_i$.

The proximate vehicle devices 2, the location data $p_i'$ of which is used, may be stationary, under certain circumstances such as, e.g., positioned in a stationary infrastructure rather than carried along in vehicles. In this case, they do not have to continuously determine their location data $p_i'$ anew, but rather may determine this data once or contain this data in the form of data stored in a predefined fashion. Such "infrastructure-bound" vehicle devices 2 also fall under the term proximate vehicle devices 2 used herein.

The predefined time T, the predefined location P and/or the length of the time segment can be stored in the vehicle device 2 or the trusted-element processor 10 during the manufacture thereof or subsequently input via the interface 11, the transmitting/receiving unit 8 or the transceiver 15.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

The invention claimed is:

1. A vehicle device for a road toll system comprising a satellite navigation receiver for continuously generating location data; and a trusted-element processor for receiving the generated location data, to log a time segment of the generated location data and to cryptographically sign said time segment, wherein the trusted-element processor starts said logging upon detection of a predefined time or a predefined location of the vehicle device and carries out said logging for a predefined time segment, and wherein the trusted-element processor detects the predefined location in external location data that it receives from proximate vehicle devices via a wireless network.

2. The vehicle device according to claim 1, wherein the trusted-element processor further detects the predefined location in its own generated location data.

3. The vehicle device according to claim 1, wherein the wireless network is an ad hoc network.

4. The vehicle device according to claim 3, wherein the ad hoc network operates in accordance with the WAVE or WLAN standard.

5. The vehicle device according to claim 1, wherein the trusted-element processor receives and matches the external location data of several proximate vehicle devices to detect the predefined location in the matched external location data.

6. The vehicle device according to claim 1, wherein the trusted-element processor to anonymously retrieves the external location data.

7. The vehicle device according to claim 1, wherein the trusted-element processor retrieves the external location data by exchanging a key having one or more of temporally and locally limited validity, and takes into consideration only external location data received under a valid key.

8. The vehicle device according to claim 1, wherein the trusted-element processor sends the signed time segment to a control center of the road toll system by the transmitting/receiving unit of the vehicle device.

9. The vehicle device according to claim 1, wherein the trusted-element processor makes the signed time segment available for retrieval via an interface of the vehicle device.

10. An ad hoc network of at least two vehicle devices according to claim 1 that are connected to one another via their transmitting/receiving units, wherein at least one vehicle device makes location data available to another vehicle device that detects a predefined location therein to start the logging of its own location data.

11. An ad hoc network of at least two vehicle devices according to claim 5 that are connected to one another via their transmitting/receiving units, wherein at least one vehicle device makes location data available to another vehicle device that detects a predefined location therein to start the logging of its own location data.

12. An ad hoc network of at least two vehicle devices according to claim 7 that are connected to one another via their transmitting/receiving units, wherein at least one vehicle device makes location data available to another vehicle device that detects a predefined location therein to start the logging of its own location data.

13. A method for logging location data of a location-recording vehicle device of a road toll system with several vehicle devices that can exchange location data in a wireless fashion, the method comprising the following steps performed in a first vehicle device:

receiving location data of a second vehicle device;

detecting a predefined location in the received location data of the second vehicle device;

logging a time segment of the location data of the first vehicle device, upon detection of the predefined location; and signing the logged time segment with a cryptographic signature.

* * * * *